US005842493A

United States Patent [19]

Yakubisin

[11] Patent Number: 5,842,493

[45] Date of Patent: Dec. 1, 1998

[54] WINDPROOF UMBRELLA HAVING AN IMPROVED RIB LINKAGE SYSTEM

[76] Inventor: Michael J. Yakubisin, 9282 Steeplechase Dr., Cincinnati, Ohio 45242

[21] Appl. No.: 876,087

[22] Filed: Jun. 13, 1997

[51] Int. Cl.[6] ..... A45B 25/00

[52] U.S. Cl. ..... 135/29; 135/31

[58] Field of Search ..... 135/29–31, 25.31, 135/25.3, 25.32, 32, 25.33, 25.34

[56] References Cited

U.S. PATENT DOCUMENTS

| | | | |
|---|---|---|---|
| 2,711,182 | 6/1955 | Kiel et al. | 135/25.31 |
| 3,893,467 | 7/1975 | Wingen | 135/25.31 |
| 4,007,752 | 2/1977 | Weber | 135/25 R |
| 5,063,953 | 11/1991 | Wu | 135/25.3 |
| 5,135,016 | 8/1992 | Stiller | 135/25.3 |
| 5,235,998 | 8/1993 | Liu | 135/25.3 |
| 5,337,770 | 8/1994 | Wang | 135/25.3 |
| 5,370,144 | 12/1994 | Yang | 135/25.31 |
| 5,435,331 | 7/1995 | Okuda | 135/29 |
| 5,551,463 | 9/1996 | Wang | 135/29 X |
| 5,553,634 | 9/1996 | Yang | 135/31 X |
| 5,597,004 | 1/1997 | Okuda | 135/29 |

*Primary Examiner*—Carl D. Friedman
*Assistant Examiner*—Beth Aubrey
*Attorney, Agent, or Firm*—Mark F. Smith; Smith, Brandenburg, Freese & Knochelmann

[57] ABSTRACT

A windproof umbrella having an improved rib linkage system which is effective for providing support for an umbrella canopy during normal operating conditions, which is capable of restoring the umbrella to a normal open water-shielding configuration after the canopy has been inverted by strong wind or a gust, which is relatively easy to operate, relatively inexpensive to manufacture, and which has relatively good reliability for use during periods of sustained winds or gusts.

11 Claims, 5 Drawing Sheets

WINDPROOF UMBRELLA HAVING AN IMPROVED RIB LINKAGE SYSTEM

FIELD OF THE INVENTION

This invention relates generally to umbrellas and, more particularly, to a windproof umbrella having an improved rib linkage system which permits the canopy to be restored to its normal configuration after being inverted by strong wind or a gust.

BACKGROUND OF THE INVENTION

Umbrellas having specially designed rib linkage systems have been utilized for providing support for umbrella canopies during normal operating conditions and which are capable of restoring the umbrella to a normal configuration after the canopy has been inverted by strong wind or a gust.

One such rib linkage system for providing support for an umbrella canopy and, after considered as being inverted, for restoring the umbrella to a normal configuration is shown and described in U.S. Pat. No. 5,435,331. The rib linkage system utilizes a strut having a U-Shaped cross-section forming a groove therein. One end of the strut is pivotally connected to a slider or runner which is slidably mounted to a main support shaft. The other end of the strut is pivotally connected to a joint member. The rib linkage system further comprises a rib or stay having one end pivotally connected to the main support shaft and the other end pivotally connected to the strut, and a tension member having one end pivotally connected to the stay and the other end pivotally connected to the joint member. When the umbrella canopy is forced into an inverted configuration by strong wind or a gust, the tension member curves or bows downwardly until the tension member and the joint member are received in the groove formed in the strut. The umbrella can be restored to a normal configuration by moving the slider downwardly along the shaft so that the tension member urges the joint member to move upward to restore the umbrella. While this construction does provide an umbrella capable of being restored to a normal open water-shielding configuration after being inverted, it has been found that during sustained winds or during periods of high wind gusts, the mechanism may be difficult to operate. This is of particular concern when the umbrella is being operated by elderly or disabled individuals.

Accordingly, a need exists for a rib linkage system for providing support for an umbrella canopy during normal operating conditions, which is capable of restoring the umbrella to a normal open water-shielding configuration after the canopy has been inverted by strong wind or a gust, which is relatively inexpensive to manufacture, and which is easier to operate than prior art rib linkage systems during periods of sustained winds or high wind gusts.

SUMMARY OF THE INVENTION

The present invention is directed to a windproof umbrella having an improved rib linkage system which is effective for providing support for an umbrella canopy during normal operating conditions, which is capable of restoring the umbrella to a normal open water-shielding configuration after the canopy has been inverted by strong wind or a gust, which is easy to operate, relatively inexpensive to manufacture, and which has relatively good reliability for use during periods of sustained winds or gusts.

In one preferred embodiment of the present invention, the windproof umbrella comprises a main support shaft having a runner slidably mounted thereon, and a plurality of rib linkage systems extending radially outwardly from the main support shaft for supporting a canopy. Each rib linkage system comprises a stretcher rib having a groove therein and having an inner end pivotally connected to the runner and an outer end pivotally connected to a joint member, a support rib pivotally connected to the main support shaft and pivotally connected to the stretcher rib, and a flexing member pivotally connected to the support rib and pivotally connected to the joint member. The joint member and the outer end of the stretcher rib are connected in such a manner that when the umbrella is forced into an inverted configuration by strong wind or a gust, the joint member rotates downwardly and contacts the stretcher rib thereby causing the stretcher rib to bow in a downward direction and, contrary to conventional rib linkage systems, causing the flexing member to bow in an upward direction.

In another preferred embodiment of the invention the umbrella can be restored to a normal open water-shielding configuration by moving the runner downwardly along the main support shaft so that the stretcher rib moves downwardly to further bow the stretcher rib and the flexing member until the forces acting on the joint member are sufficient to rotate the outer main rib downwardly to effect the desired restoration operation.

In another preferred embodiment of the invention, the joint member is provided with a tang portion having at least one axially facing tang adapted to pivotally support the second end of the stretch rib, a bifurcated portion having first and second parallel surfaces for receiving the second end of the flexing member, and a flexible portion integrally formed with the tang portion and the bifurcated portion.

In another preferred embodiment of the invention, the stretcher rib and the flexing member are pivotally connected to the joint member by use of rivets.

A primary object of this invention, therefore, is to provide a windproof umbrella having an improved rib linkage system which is effective for providing support for an umbrella canopy during normal operating conditions and which is capable of restoring the umbrella to a normal open water-shielding configuration after the canopy has been inverted by strong wind or a gust.

Another primary object of this invention is to provide a windproof umbrella having an improved rib linkage system which is relatively easy to operate.

Another primary object of this invention is to provide a windproof umbrella having an improved rib linkage system which is relatively inexpensive to manufacture.

Another primary object of this invention is to provide a windproof umbrella having an improved rib linkage system which is more reliable than conventional rib linkage systems.

These and other objects and advantages of the invention will be apparent from the following description, the accompanying drawings and the appended claims.

DETAILED DESCRIPTION OF THE PREFERRED EMBODIMENT

Figure 1:
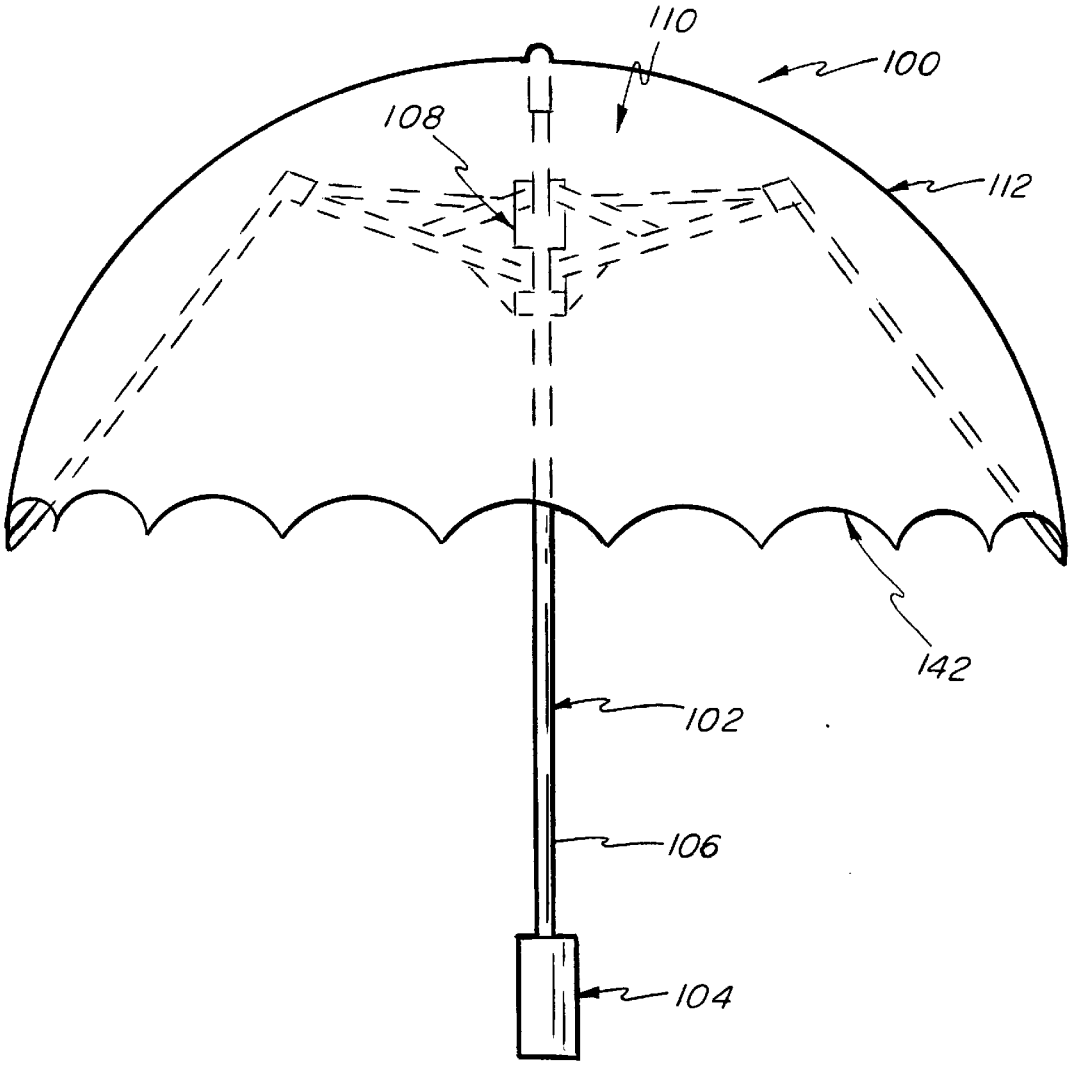
FIG. 1 is a pictorial view of the umbrella of the present invention shown in its normal open water-shielding configuration.

Referring to FIG. 1, a windproof umbrella of the present invention, generally designated 100, comprises a main support shaft 102 having a handle 104 secured to the lower portion 106 of the main support shaft 102 and a runner 108 slidably held on the main support shaft 102. In practice, the main support shaft 102, the handle 104, and the runner 108 of the present invention are conventional and their structure and function are well known to one skilled in the art. The runner 108 is shown in its upward position to urge the rib linkage system, generally designated 110, radially outwardly from the main support shaft 102 to hold a flexible, water-resistant material canopy 112 in a normal open rain-shielding configuration and is held in place by a conventional set of latches 114 (FIG. 2), or by any other well known manner. Because of the dimensions of the canopy 112 and the connections between the ribs and the struts comprising the rib linkage system 110 of the present invention, the canopy 112 will assume a curved appearance when the umbrella 100 is in a full open water-shielding configuration.

Figure 2:
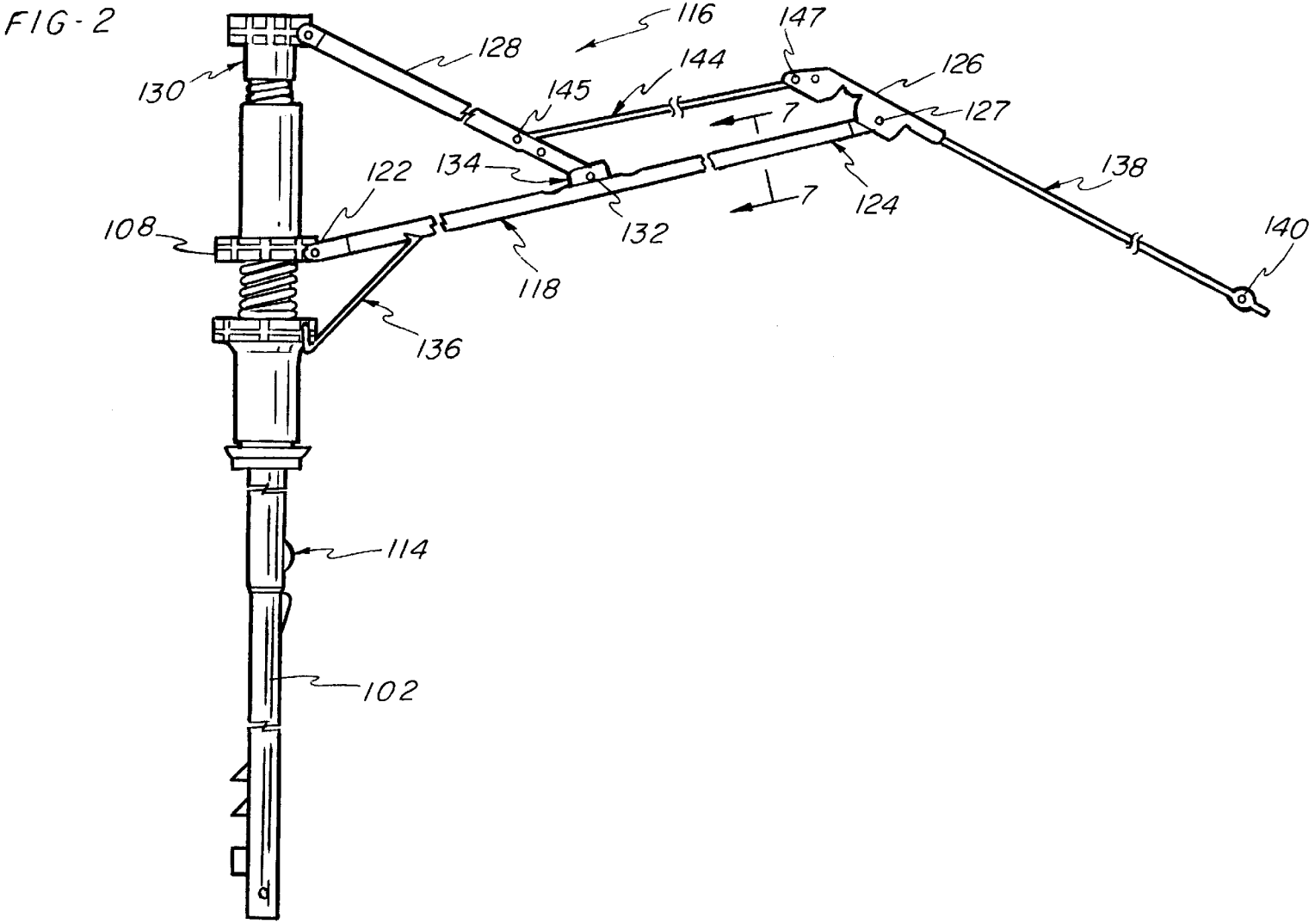
FIG. 2 is a partial plan view of a portion of the rib linkage system of the present invention in a normal open water-shielding configuration.
Figure 5:
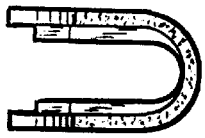
FIG. 5 is an enlarged view of the joint member of FIG. 3 taken along lines 5—5.
Figure 3:
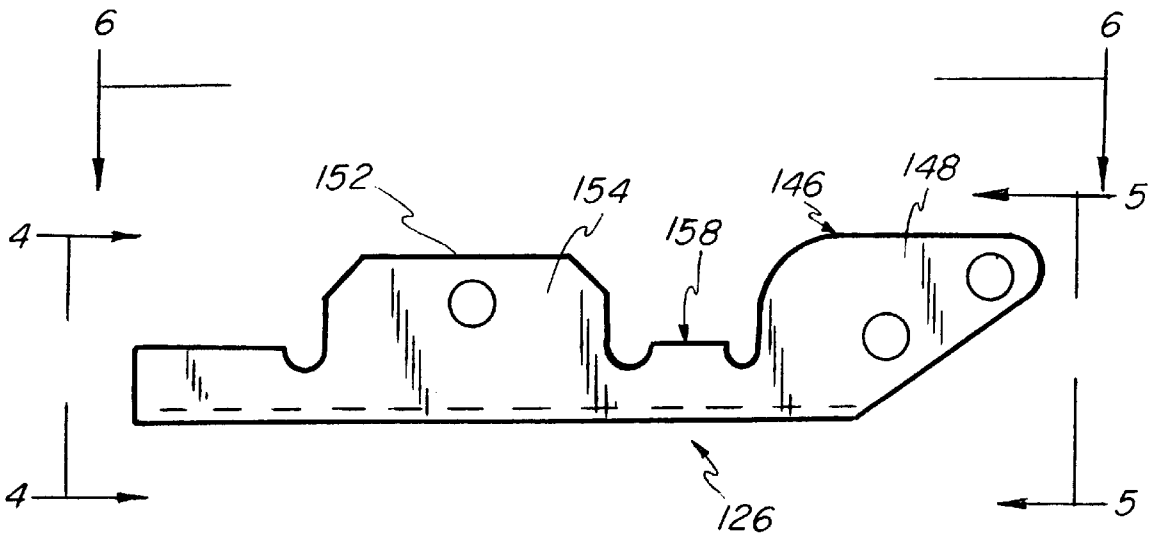
FIG. 3 is an enlarged view of the joint member of the present invention.
Figure 4:
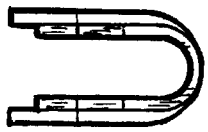
FIG. 4 is an enlarged view of the joint member of FIG. 3 taken along lines 4—4.
Figure 6:
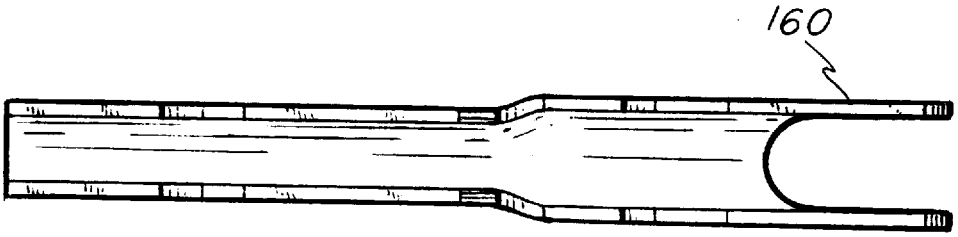
FIG. 6 is an enlarged view of the joint member of FIG. 3 taken along lines 6—6.

Referring to FIGS. 1 and 2, the rib linkage system 110 comprises a plurality of individual arms 116 extending in a general radial direction outwardly from the main support shaft 102 to provide a support frame for the flexible canopy 112. Each individual arm 116 of the present invention comprises a stretcher rib 118 having a groove 120 (FIG. 7) therein and includes an inner end 122 pivotally connected to the upper portion of the runner 108 and an outer end 124 pivotally connected to a joint member 126 by a rivet 127. A support rib 128 having a generally V-shaped cross-section is pivotally connected to the upper portion 130 of the main support shaft 102 and is pivotally connected by a rivet 132 to integrally formed bifurcated lugs 134 protruding upwardly from the stretcher rib 118. A hook wire 136 is pivotally connected to the runner 108 and stretcher rib 118 and is formed from stainless steel wire or other similar resilient material to provide stability during opening and closing of the umbrella. An outer main rib 138 is rigidly connected to the joint member 126 and includes an eyelet 140 at its outer end for conventionally securing to the peripheral edge 142 of the canopy 112 by string, wire, thread, or other like means. A flexing member 144, preferably formed from a resilient material such as a thin stainless steel wire or the like, is pivotally connected to the support rib 128 and the joint member 126 by rivets 145 and 147, respectively.

Referring to FIGS. 2 through 6, the joint member 126 comprises a tang portion 146 having axially facing bifurcated tangs 148 for receiving one end of the flexing member 144 therebetween, a lug portion 152 having bifurcated lugs 154 protruding outwardly from the joint member 126 for receiving the outer end 124 of the stretcher rib 118 therebetween, a flexible portion 158 integrally formed with the tang portion 146 and the lug portion 152, and a longitudinally extending stem 160 having a U-shaped cross section adapted to receive the inner end of the outer main rib 138 and is fixedly secured thereto by crimping or by other conventional means.

Figure 7:
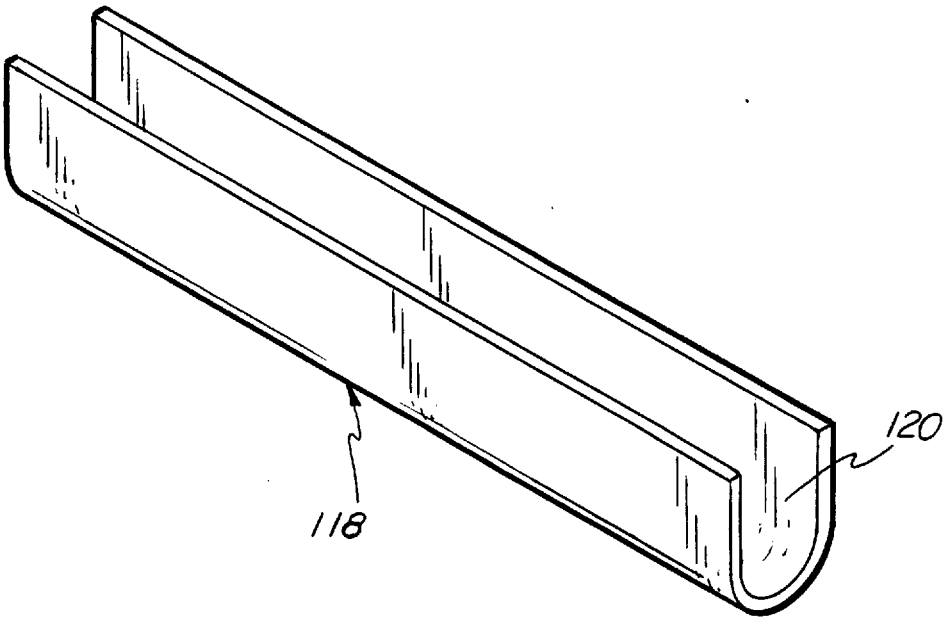
FIG. 7 is an enlarged perspective view of a portion of the stretcher rib taken along lines 7—7 of FIG. 2 showing the groove therein.
Figure 8:
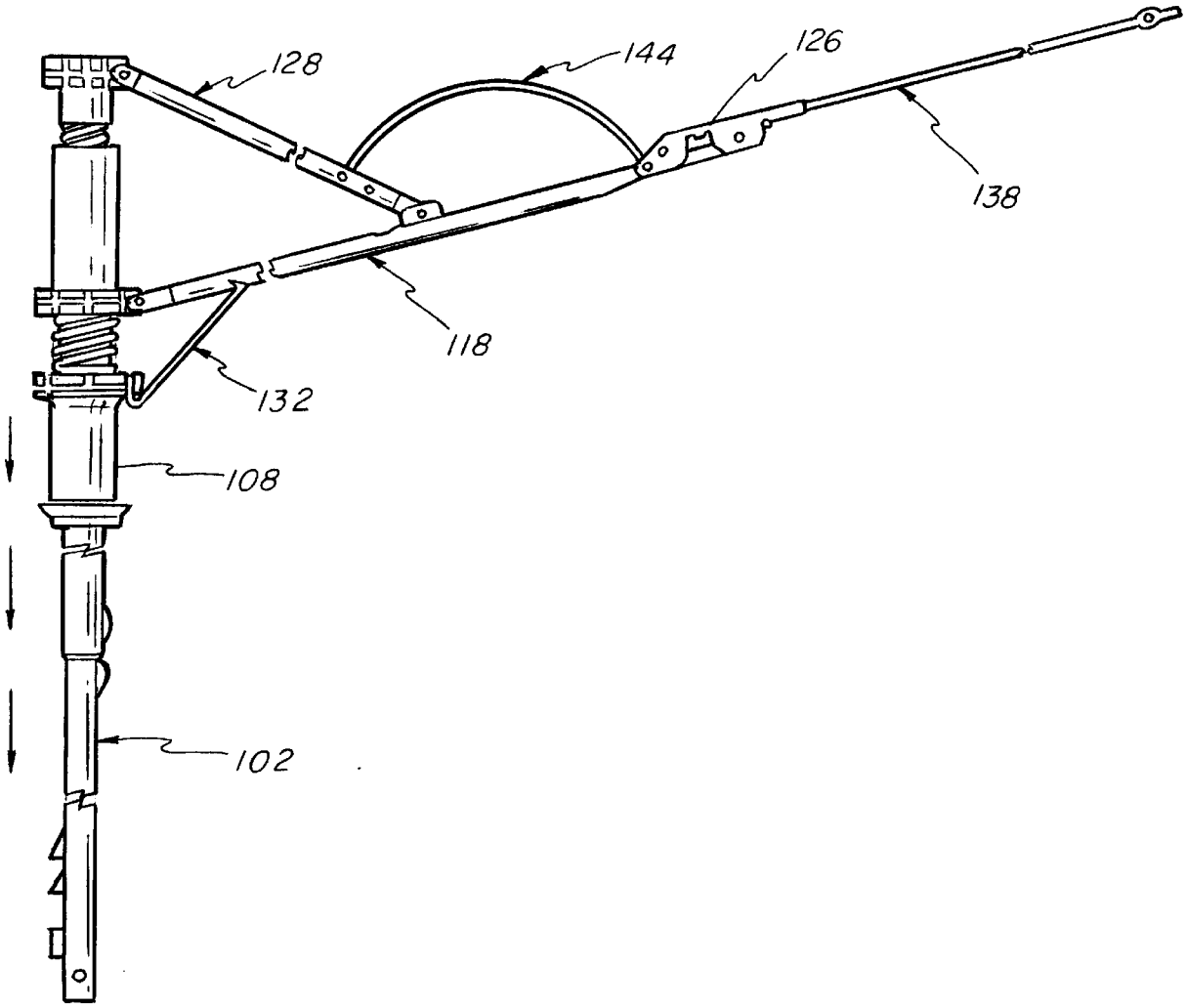
FIG. 8 is a partial plan view of a portion of the rib linkage system of the present invention in a fully open, inverted configuration.

As stated hereinabove, during use a strong wind or gust may exert a force against the inner surface of the canopy 112 causing the canopy to invert from a normal open water-shielding configuration to an upwardly curved inverted configuration. As shown in FIG. 7, during such a inverted configuration, the joint member 126 is forced to rotate downwardly such that the tang portion 146 straddles the groove 120 formed in the stretcher rib 118 thereby causing the stretcher rib 118 to bow in a downward direction away from the canopy 112 and, contrary to conventional inverted rib linkage systems, causing the flexing member 144 to bow in an upward direction towards the canopy 112.

In order to restore the umbrella 100 to a normal open rain-shielding configuration, the runner 108 is moved downwardly along the main support shaft 102, as shown by arrows in FIG. 7, by the user in the same manner as used for closing the umbrella. The downward movement of the runner 108 causes the inner end 122 of the stretcher rib 118 to move downwardly to further bow the stretcher rib 118 and increase the force being exerted by the outer end 124 of the stretcher rib 118 against the tang portion 146 of the joint member 126. This urging of the outer end 124 of the stretcher rib 118 against the tang portion 146 of the joint member 126 causes the support rib 128 to rotate thereby increasing the bowing of the flexing member 144. As the runner 108 continues to move downwardly along the main support shaft 102, the force being exerted against the joint member 126 by the outer end 124 of the stretcher rib 118 increases until the forces on the joint member 126 from the downward bowing of the stretcher rib 118 and the upward bowing of the flexing member 144 are sufficient to rotate the outer main rib 138 downwardly to effect the desired restoration operation. The flexible portion 158 of the joint member 126 permits slight bending of the joint member 126 to absorb a portion of the force being exerted by the flexing member 144 thereby making it easier for the user to fully close the umbrella. It should now be apparent to one skilled in the art that the flexible portion 158 may be lengthened or shortened to vary the amount of resistance to closing the umbrella.

In order to provide greater flexibility, rivets 145 and 147 are preferably formed from brass, however, other flexible materials, such as steel, may be suitable, whereas to ensure proper strength rivets 127 and 132 are preferably formed from a stainless steel.

There has thus been provided a novel windproof umbrella having an improved rib linkage system. The rib linkage system of the present invention provides support for an umbrella canopy during normal operating conditions and is capable of restoring the umbrella to a normal configuration after the canopy has been inverted by a strong wind or gust. Further, the rib linkage system is relatively inexpensive to manufacture and is more reliable than prior art rib linkage systems for operating during sustained winds or during periods of high wind gusts. It should now be apparent to one skilled in the art that the downward bowing of the stretcher rib and the opposite upward bowing of the flexing member of the present invention cooperate to permit the umbrella to be relatively easily restored to its normal open water-shielding configuration. It should also be apparent to one skilled in the art that the present is relatively easy and inexpensive to manufacture.

Although this invention has been shown and described with respect to detailed embodiments thereof, it will be understood by those skilled in the art that various changes in form and detail thereof may be made without departing from the spirit and scope of the claimed invention.

What is claimed is:

1. A windproof umbrella comprising:

a main support shaft having a runner slidably mounted thereon;

a flexible canopy; and a rib linkage system;

wherein said rib linkage system comprises:

a joint member;

an outer main rib fixedly secured to said joint member;

a stretcher rib having an inner end pivotally connected to said runner and an outer end pivotally connected to said joint member;

a support rib pivotally connected to said main support shaft and pivotally connected to said stretcher rib; and a flexing member pivotally connected to said support rib and pivotally connected to said joint member such that when the canopy has been inverted the flexing member is bowed upwardly towards the canopy.

2. The windproof umbrella of claim 1 wherein the joint member includes a flexible portion for absorbing a portion of the force being exerted therein by said flexing member.

3. The windproof umbrella of claim 1 wherein said joint member comprises a tang portion having bifurcated tangs receiving one end of said flexing member therebetween, a lug portion having bifurcated lugs protruding outwardly therefrom receiving one end of said stretcher rib therebetween, a flexible portion integrally formed with said tang portion and said lug portion, and a stem connecting to said outer main rib.

4. The windproof umbrella of claim 1 wherein said flexing member is pivotally connected to said support rib and to said joint member by rivets formed from brass.

5. The windproof umbrella of claim 1 wherein said stretcher rib is pivotally connected to said joint member by a rivet and said support rib is pivotally connected to said stretcher rib by a rivet, wherein said rivets are formed from a stainless steel.

6. A windproof umbrella comprising:

a main support shaft having a runner slidably mounted thereon;

a flexible canopy;

a joint member;

an outer main rib fixedly secured to said joint member;

a stretcher rib having an inner end pivotally connected to said runner and an outer end pivotally connected to said joint member;

a support rib pivotally connected to said main support shaft and pivotally connected to said stretcher rib; and a flexing member pivotally connected to said support rib and pivotally connected to said joint member;

wherein when the umbrella is in an upwardly bowed inverted configuration, said joint member is rotated downwardly away from said canopy into contact with said stretcher rib to cause said stretcher rib to bow in a downward direction away from said canopy and to cause said flexing member to bow in an upward direction towards said canopy.

7. The windproof umbrella of claim 6 wherein when said runner is moved downwardly along said main support shaft such that said stretcher rib is further bowed in a downward direction and said flexing member is further bowed in an upward direction thereby causing said outer main rib to rotate to restore the umbrella to its normal open rain-shielding configuration.

8. The windproof umbrella of claim 6 wherein the joint member includes a flexible portion for absorbing a portion of the force being exerted therein by said flexing member.

9. The windproof umbrella of claim 6 wherein said joint member comprises a tang portion having bifurcated tangs receiving one end of said flexing member therebetween, a lug portion having bifurcated lugs protruding outwardly thereform receiving one end of said stretcher rib therebetween, a flexible portion integrally formed with said tang portion and with said lug portion, and a stem connecting to said outer main rib.

10. The windproof umbrella of claim 6 wherein said flexing member is pivotally connected to said support rib and to said joint member by rivets formed from brass.

11. The windproof umbrella of claim 6 wherein said stretcher rib is pivotally connected to said joint member by a rivet and said support rib is pivotally connected to said stretcher rib by a rivet, wherein said rivets are formed from a stainless steel.

* * * * *